United States Patent [19]

Smit et al.

[11] Patent Number: 4,584,571

[45] Date of Patent: Apr. 22, 1986

[54] MAGNETIC ARTICLE THEFT ALARM

[75] Inventors: Johannes W. M. Smit, Waalwijk; Gerard J. A. Spoorenberg, Geertruidenberg, both of Netherlands

[73] Assignee: Castelijn & Beerens Lederwaren B.V., Waalwijk, Netherlands

[21] Appl. No.: 553,072

[22] Filed: Nov. 18, 1983

[30] Foreign Application Priority Data

Nov. 19, 1982 [NL] Netherlands ..... 8204500

[51] Int. Cl.[4] ..... G08B 13/14

[52] U.S. Cl. ..... 340/572; 340/568; 340/574

[58] Field of Search ..... 340/572, 568, 574

[56] References Cited

U.S. PATENT DOCUMENTS

| | | | |
|---|---|---|---|
| 3,247,502 | 4/1966 | Eberts | 340/568 |
| 3,277,465 | 10/1966 | Potter | 340/384 E |
| 3,295,575 | 1/1967 | Young | 150/47 |
| 3,530,451 | 9/1970 | Devine | 340/572 |
| 3,930,249 | 12/1975 | Steck et al. | 340/571 |
| 4,374,377 | 2/1983 | Saito et al. | 340/384 E |

FOREIGN PATENT DOCUMENTS

| | | | |
|---|---|---|---|
| 1269015 | 5/1968 | Fed. Rep. of Germany | 340/572 |

*Primary Examiner*—Glen R. Swann, III

*Attorney, Agent, or Firm*—Birch, Stewart, Kolasch & Birch

[57] ABSTRACT

A portable alarm device is positioned in a garment, bag or the like to protect valuable articles located therein, such as wallets. The device includes a casing provided with a power source and a circuit fed by said power source, the circuit including at least one magnetically sensitive element, and at least one signal member serially connected therewith, and a permanent magnetic body attached to the valuable article and cooperating with the at least one magnetically sensitive element to open and close the circuit. In a further refinement, two or more reed switches are connected in series and spaced apart a distance less than the range over which the permanent magnet can control one of the switches so the article can move about within a bag without causing an alarm.

7 Claims, 6 Drawing Figures

MAGNETIC ARTICLE THEFT ALARM

BACKGROUND OF THE INVENTION

The invention relates to a portable alarm device, adapted to be carried in garments, bags and the like to protect valuable articles, such as wallets and the like.

SUMMARY OF THE INVENTION

The object of the invention is to provide a handy device which does not disturb the user which is easy to operate. Moreover it gives the user a safe feeling as it will immediately warn when valuable articles are removed by pick-pockets or the like.

The device according to the invention includes a casing provided with a power source and a circuit fed by said power source, said circuit incorporating at least one magnetic sensitive switch and in series therewith at least one signalling means. A permanent magnetic body is adapted to be connected to said valuable articles. When said magnetic body is removed together with said valuable object out of the sensitive range of said switch, the signalling means is actuated through said switch by said power source and therefore generate a signal to the user. Said optical or audible signal provides the user immediately with an indication that he or she has to do something.

In order to enlarge the working range of the alarm device according to the invention which may be necessary for brief-cases and the like, said circuit incorporates more than one magnetic switch means in series to each other, whereas the spatial distance between two switch contacts is at least equal to the size of the operative field of said magnetic body. With such a circuit it is sufficient to hold one of the switch contacts open, in order to prevent the actuation of said signalling member. As soon as all contacts are closed the signalling member will be actuated. Said contacts are placed over a larger area, such that said valuable article bearing said magnetic body can freely move in said bag or pouch.

Preferably said magnetic switch is a REED-alternating switch, which switch, owing to its sensitivity prevents the necessity of considering the magnetic field vectors and therefor the position of said magnetic body. The user is therefor free to put away the valuable articles in various desired positions.

It is further preferred to construct the signal member in the form of an oscillator driven vibrating plate transducer said vibrator-plate transducer fitting in a casing constructed as an resonance-box. A low voltage power source is sufficient to provide a audible signal of 80 decibel at the range of 1 meter.

Finally it is preferred to have the magnetic body in the form of a plate, for instance a flexible plastic strip-material. Such a plate can be integral with said valuable article, what will enhance the esthetic design of said article, for instance a wallet.

The invention will be further clarified in the detailed description herebelow, of a number of embodiments.

BRIEF DESCRIPTION OF THE DRAWINGS

The present invention will be better understood with the aid of the detailed description presented hereinbelow and the accompanying drawings wherein.

DETAILED DESCRIPTION OF THE PREFERRED EMBODIMENTS

Figure 1:
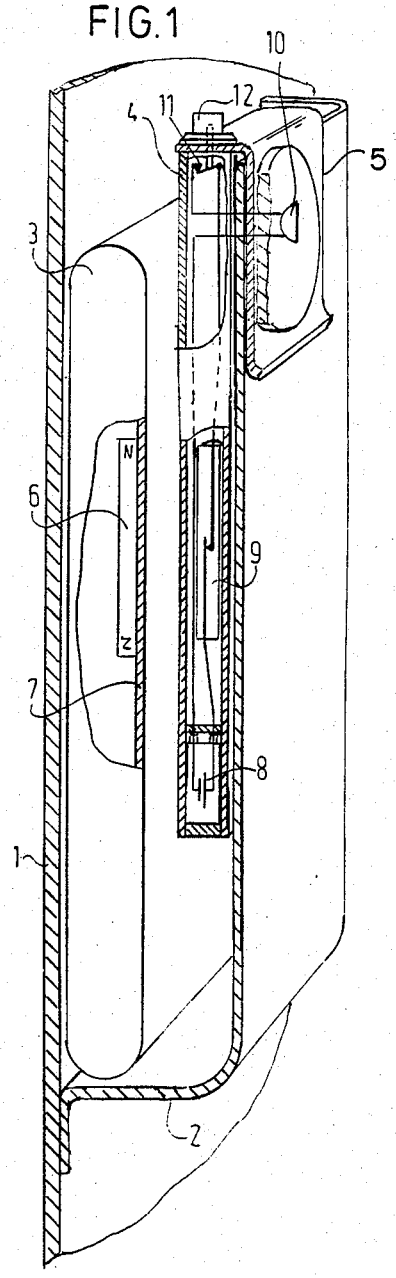
FIG. 1 is a schematic, elevated section of a lining of a garment with an inner pouch and alarm device according to the invention disposed therein.

In FIG. 1 the reference number 1 refers to the outer side of said garment, the inner side of which a pouch 2 is arranged.

In the pouch 2, a wallet 3 is disposed as well as a casing 4, which casing is fastened by means of a clip 5 to the inner pouch. The wallet is provided with a magnetic body 6 in the form of a bar-magnet, but it is clearly within the scope of the invention to construct said magnet in any other form. It is possible to make said magnetic body of a flexible plastic-strip, being integral with the wall 7 of the wallet 3. The casing 4 is provided with a power source 8, which supplies power to a circuit which incorporates a so-called REED-contact 9 and a signal member 10 in series therewith. In between the signal member 10 and the REED-contact 9 a manually operated switch 11 is located, which can be actuated by a push button 12.

Figure 2:
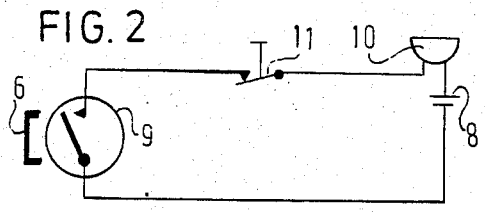
FIG. 2 is a diagram of the circuit used in the alarm device of the present invention.

The circuit as described hereabove is also disclosed in FIG. 2, wherein similar reference numbers are used for the corresponding parts.

The device of the present application works as follows: by placing the magnet 6 in the neighborhood of the contact 9, the contact will be held open. As soon as the magnet 6 is removed, the contact 9 will close, and thereupon the signal member 10 will emit a audible or visible signal due to the actuation by said power source 8. As soon as the wallet is placed back, said REED-contact 9 will open again, whereupon the circuit is broken. The circuit will also be broken when said manually operated contact 11 is opened by the user himself.

Figure 3:
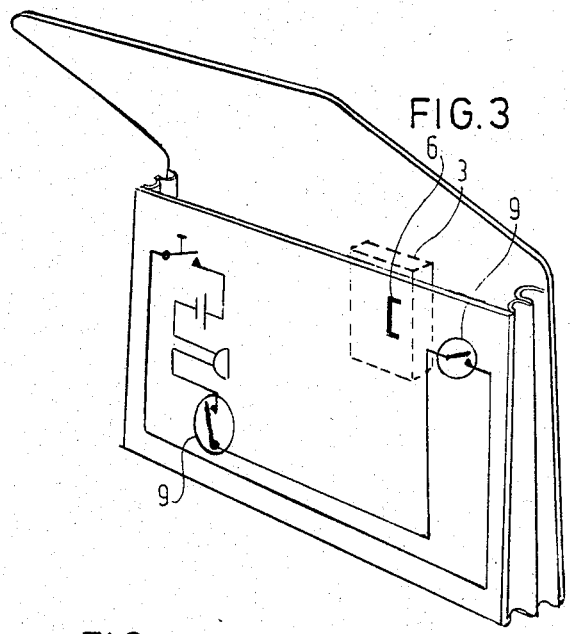
FIG. 3 is an alternative diagram for a circuit of the present invention disposed in a brief-case.

FIG. 3 discloses a diagram of the circuit similar to that of FIG. 2 but incorporating a pair of REED-contact 9 placed in series with each other. This means that the valuable article 3 including a magnet 6, when in the neighborhood of either one of the contacts 9 will open the circuit, so preventing a signal. As soon as the valuable article 3 is removed both REED-contacts 9 will fall beyond the magnetic field of magnet 6, and the circuit will be closed, so emitting a signal. Both REED-contacts are placed at 90° to each other in order to enlarge the sensitivity to said magnetic field.

Figure 4:
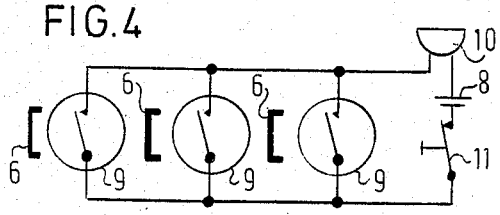
FIGS. 4, 5 and 6 are each an alternative embodiment of a circuit for a alarm-device according to the invention.
Figure 5:
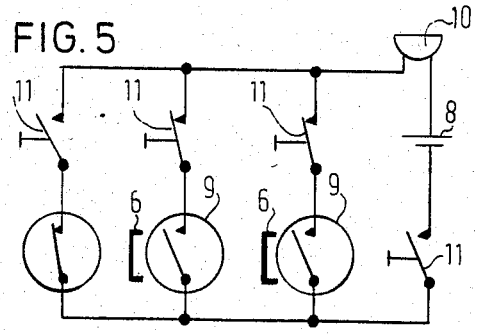

FIGS. 4 and 5 both disclose an embodiment in which the REED-contacts 9 are placed parallel to each other. This embodiment is adapted for use in a bag or garment having more than one pouch. In each pouch a valuable article therein can be protected.

FIG. 5 demonstrates the use of a switch with manually operated contacts 11 in order to open or close a circuit incorporating a REED-contact. The system according to FIGS. 4 and 5 will be actuated in the same manner as the system described hereabove.

Figure 6:
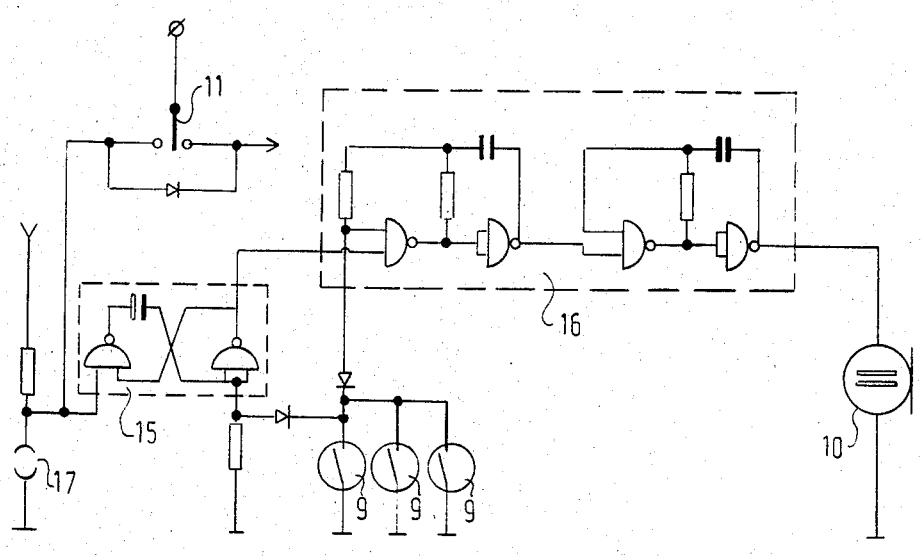

FIG. 6 discloses a circuit provided with a timing means 15, which also establishes a signal after the valuable article has been removed by the user during a certain time interval. This timing means warns the user when he has left his wallet unattended. Said timing means can be made by any suitable electronic components, such as NAND-gate circuits.

The signal from the timing means is provided to an oscillator 16 circuit controlling the signalling member 10 which is a ceramic beeper. The circuit also includes a touch sensitive switch 17, which can be made operable by the two position switches 11.

Within the scope of the invention other embodiments are possible. The signal means may be located in a different way than disclosed in FIG. 1, outside the casing 4, for example in the clip 5 in order to emit a better audible signal, not disturbed by the lining of the garment.

What is claimed is:

1. A portable alarm for preventing the theft of an article from a cavity in a garment, bag, or the like comprising:

a permanent magnetic body attached to said article;

a casing attached to said garment, bag or the like;

at least two magnetic switch means disposed in said casing and serially connected, for sensing the proximity of said permanent magnetic body attached to said article, said switch means being open in response to the proximity of said permanent magnetic body and being otherwise closed;

a power source serially connected with said at least two magnetic switch means; and a signalling device serially connected to said at least two magnetic switch means and said power source, said signalling device notifying a user of said garment, bag or the like when all of said switch means are closed to signal that said article has been removed from proximity with any of said magnetic switch means;

said at least two magnetic switch means being spaced apart within said cavity at a distance no more than the distance within which a said magnetic switch means will respond to said permanent magnetic body so as to allow said article to shift in said cavity without activating said alarm.

2. An alarm device as claimed in claim 1 wherein each said magnetic switch means is a REED-alternating switch.

3. An alarm device as claimed in claim 1 wherein said signalling device is an oscillator controlled vibrating-plate, which vibrating-plate fits in said casing made as a resonance box, to emit an audible signal.

4. An alarm device as claimed in claim 1 wherein said circuit is provided with a manually operated ON-OFF switch serially connected to said at least two magnetic switch means to selectively disable said alarm.

5. An alarm device as claimed in claim 1 wherein said magnetic body is a strip.

6. An alarm device as claimed in claim 5 wherein said strip is made from flexible material.

7. An alarm device as claimed in claim 1 wherein said magnetic body is formed integral with said article.

* * * * *